United States Patent [19]

Bralich

[11] Patent Number: 5,007,451

[45] Date of Patent: Apr. 16, 1991

[54] SUMP PROTECTION SYSTEM

[76] Inventor: Andrew Bralich, 2485 W. 9th St., Oshkosh, Wis. 54904

[21] Appl. No.: 358,132

[22] Filed: May 30, 1989

[51] Int. Cl.[5] ..... E02D 19/06; F04B 49/04

[52] U.S. Cl. ..... 137/362; 417/41; 52/169.5

[58] Field of Search ..... 137/362; 52/169.5; 417/40, 41

[56] References Cited

U.S. PATENT DOCUMENTS

| | | | |
|---|---|---|---|
| 349,735 | 9/1886 | Nicaise | 52/169.5 |
| 1,034,340 | 7/1912 | Bishop | 137/362 X |
| 3,017,722 | 1/1962 | Smith | 52/169.5 |
| 3,425,175 | 2/1969 | Gerde | 52/169.5 |
| 4,553,561 | 11/1985 | Morris | 137/362 |
| 4,852,609 | 8/1989 | Schoenauer | 137/362 X |
| 4,890,425 | 1/1990 | Mamula | 52/169.5 X |

*Primary Examiner*—John Rivell
*Attorney, Agent, or Firm*—Donald Cayen

[57] ABSTRACT

A simple and inexpensive sump protection system comprises a retainer that is placed on a building floor over a sump and a hose that leads from the retainer. The protector is formed as a short tube with an annular flange extending from one end thereof. A seal on the underside of the flange contacts the floor to confine water rising in the sump above the floor level. A spout is formed in the tube. Water rising in the retainer is led harmlessly to a drain by means of a hose clamped over the spout. If desired, suitable weights at hand can be placed on the tube to enhance sealing between the retainer and the floor.

2 Claims, 1 Drawing Sheet

SUMP PROTECTION SYSTEM

BACKGROUND OF THE INVENTION

1. Field of the Invention

This invention pertains to water control, and more particularly to apparatus for preventing water overflow from a building drainage system.

2. Description of the Prior Art

It is a common practice to construct homes and other buildings with ground water collection systems. Typically, the collection system includes a sump built into the basement or other lowermost floor. Tile and stone are set in place around and under the building periphery and are led to the sump. Ground and rain water adjacent the building is directed to the sump, from which it is removed by a sump pump and discharged at a location away from the building. Normally, the sump pump is actuated by a float switch to operate only when a predetermined height of water has collected in the sump.

Unfortunately, during times of heavy rainfall or rapid snow melting, water may collect in the sump faster than the pump can remove it. In addition, electrical power failure and float switch malfunction can prevent water that accumulates at even a normal rate from being properly removed. In those situations, the sump overflows. The results associated with sump overflow are well known. They range from minor inconvenience to major loss of property. Further, even with a properly functioning system, the building owner is subjected to worry lest his system fails at a critical time. He is therefore apt to forego leaving the premises in order to keep a watch on his collection system.

Some attempts have been made to solve the problem of an overflowing sump. For example, U.S. Pat. No. 3,562,982 shows a building wall having cement blocks with slots in them. The slotted blocks open into adjacent slotted blocks and also into a gravel bed under the building floor. Water collecting under the floor flows through the slots into the blocks, where it evaporates or is led by an underground pipe from the building. In one embodiment, water in the blocks is led to a sump, from which it is pumped by a conventional sump pump. The system of the U.S. Pat. No. 3,562,982 cannot protect against overflow of the sump or against water backflowing through the slotted wall blocks.

U.S. Pat. No. 3,990,469 describes a channel of angle irons sealed to the building floor along the interior walls. The channels lead to a drain. Water leaking through the walls collects in the channels and flows to the drain. In addition to the unsightly nature of the wall angle iron channels, there is no provision in the structure of the U.S. Pat. No. 3,990,469 to prevent overflowing of the drain.

U.S. Pat. No. 4,553,561 discloses one or more large containers placed over a sump for retaining excess sump water. The excess water is stored in the containers, from which the water is drained through valved outlets. The uppermost container is covered. The apparatus of the U.S. Pat. No. 4,553,561 is undesirably large, complicated, and expensive. Moreover, use of an expensive submersible pump is required.

Thus, a need exists for a simple and reliable device for controlling sump overflow.

SUMMARY OF THE INVENTION

In accordance with the present invention, an inexpensive and dependable sump protection system is provided that controls water that overflows a conventional sump. This is accomplished by apparatus that includes a simple retainer placed in surface contact with a building floor and surrounding the sump.

The retainer is preferably in the form of a tube having a height of only a few inches. The retainer need not be covered. To seal the retainer against the building floor, a soft flexible seal is inserted into an annular groove formed in a flange on one end of the tube. If desired, a weight of any convenient kind can be placed on top of the retainer to compress the seal against the floor.

To drain any water rising from the sump above the floor level and into the retainer, a simple spout is formed in the tube. A conventional hose is clamped over the spout to direct the water overflow to a suitable drain.

Other advantages, benefits, and features of the invention will become apparent to those skilled in the art upon reading the description of the preferred embodiment.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 2:
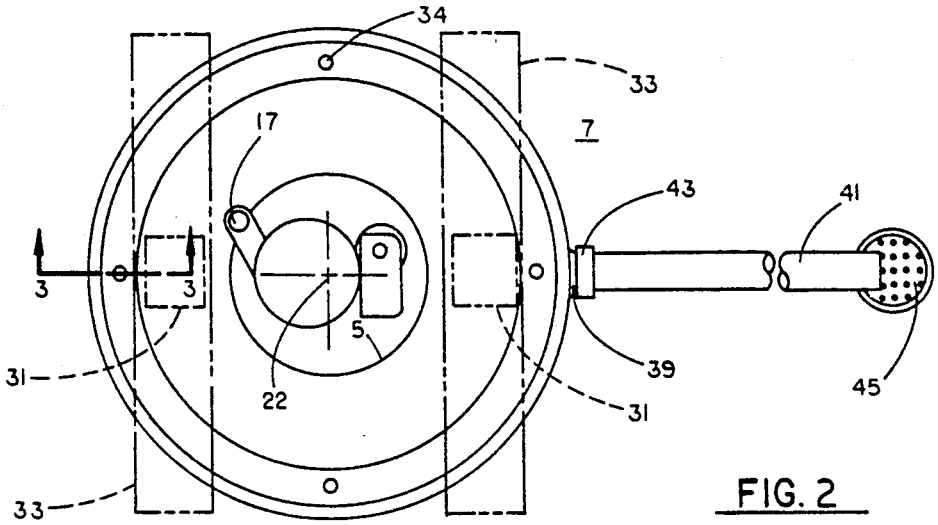
FIG. 2 is a top view of the present invention shown installed over a building sump.
Figure 1:
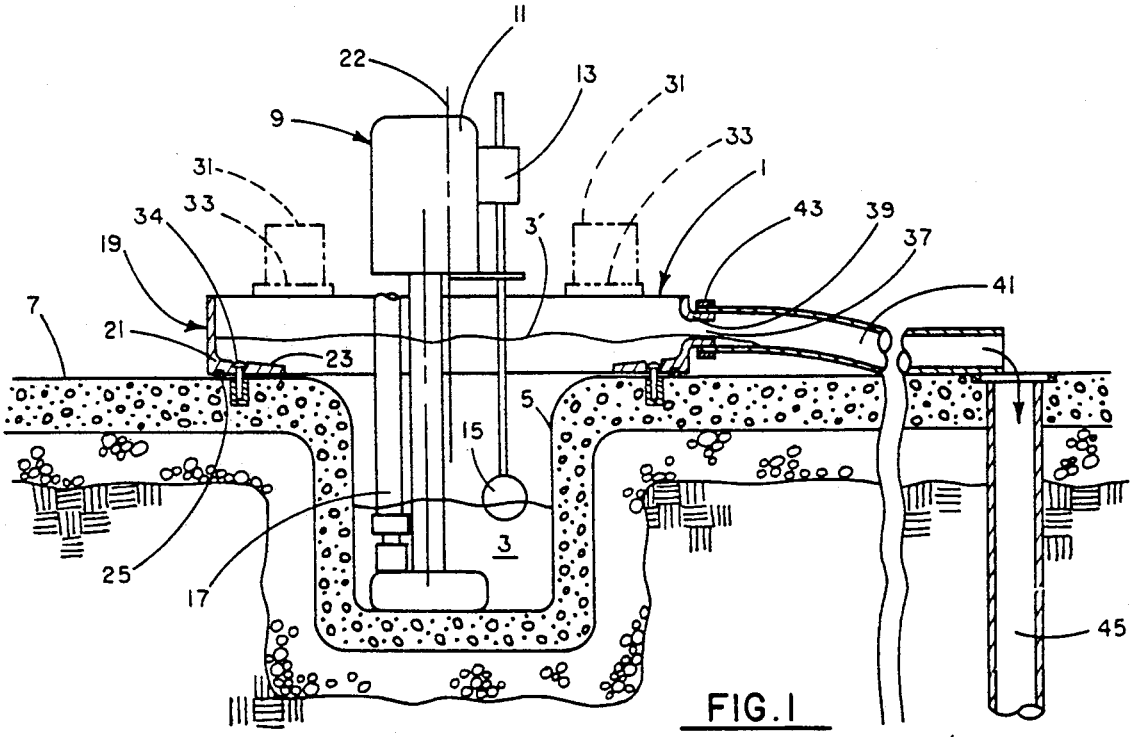
FIG. 1 is a longitudinal cross sectional view of the present invention shown installed over a building sump.

Referring to FIGS. 1 and 2, a sump protection system 1 is illustrated that includes the present invention. The sump protection system is particularly useful for preventing damage from water 3 that overflows from a conventional building sump 5, but it will be understood that the invention is not limited to indoor flood control applications.

The sump 5 is built into a building floor 7, as is known in the building construction art. The floor construction adjacent the sump may be of any of numerous designs, including floors having raised aprons or upstanding short lips surrounding the sump. Older construction, as is depicted, may simply have a sloped edge of the floor material, such as concrete, formed integrally with the floor and leading into the sump.

Typically, a sump pump 9 is placed in the sump 5, with the motor 11 and wire box 13 well above the level of the floor 7. A float 15 operates a switch in the wire box 13 in correlation with the level of the water 3. The pump water is discharged through a stand pipe and connected hose 17 in known manner.

In accordance with the present invention, the sump protection system 1 prevents damage to the building and its contents if the water 3 rises in the sump 5 above the floor 7. For that purpose, the sump protection system includes a retainer 19 that surrounds the sump and is in contact with the building floor 7. The retainer 19 comprises a short tube section 21 having a central axis 22 and an annular flange 23 extending radially from the bottom end of the tube section. The inner diameter of the flange 23 is preferably several inches larger than the diameter of the sump 5, so that when the retainer is placed over the sump the flange rests on a fairly level area of the floor surface. It is preferred that the upper surface 35 of the flange taper somewhat toward the bottom surface 29 in the direction of the central axis 22, FIG. 3.

Figure 5:
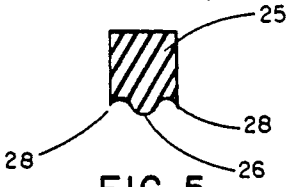
FIG. 5 is an enlarged cross sectional view of a seal used with the present invention.

To seal the retainer 19 against the building floor 7, a seal 25 is employed in conjunction with the flange 23. Looking also at FIG. 3, the seal 25 may be retained in an annular groove in the bottom surface 29 of the flange. Alternately, the seal may be bonded directly to the flange bottom surface 29 without inserting it into a groove. I have found that a linear seal sold under the trademark DIKE-O-LASTIC works very well. That seal has a central lip 26 and a pair of side corner ridges 28, as are shown in FIG. 5. When placed in contact with the floor, the lip 26 compresses to form an effective seal against the floor. Although not necessary for the successful operation of the sump protection system 1, weights of any convenient kind, such as blocks 31 placed on respective boards 33 that span the tube section, may be employed to provide additional compression to the seal lip 26 and the edge ridges 28. Alternately, the retainer may be attached more or less permanently to the floor by means of concrete fasteners 34. A slight tightening of the fasteners 34 provides ample compression of the seal 25 for effective sealing. As a result, when the retainer is placed on the building floor 7 over the sump 5, any water 3 that rises above the floor will be confined to the localized area defined by the retainer.

To reliably remove the water confined in the retainer 19, such as water that has risen to a level 3', the retainer tube section 21 is formed with an opening 37. In the preferred embodiment, the opening 37 is in the form of a spout 39, which may be a short tube formed integrally with and at generally right angles to the tube section 21. In that manner, water rising from the sump and generally confined by the retainer is allowed to escape by flowing out the spout 39. To control the water leaving the spout, a conventional hose or flexible tube 41 is connected to the spout, as by a clamp 43. The free end of the hose 41 is placed over the building floor drain or trap 45. Consequently, any water 3' that rises out of the sump 5 due to equipment malfunction or excessively rapid ground water collection is directed harmlessly to the drain 45.

By using the sump protection system of the present invention, the building owner is freed from the worry of a flooded basement due to melting snow in the spring of the year and flash storms in the summer and fall. During winter and times when the building owner is always present, the sump protection system may be taken up and stored in any convenient location. On the other hand, if desired, the retainer 29 may be left in place over the sump, but the hose 41 can be unclamped and stored nearby until needed again.

Figure 3:
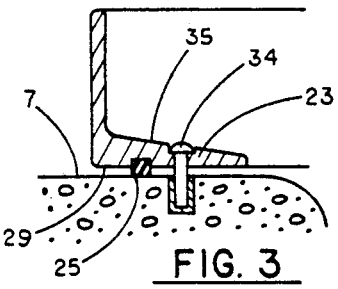
FIG. 3 is an enlarged cross sectional view taken along lines 3—3 of FIG. 2.
Figure 4:
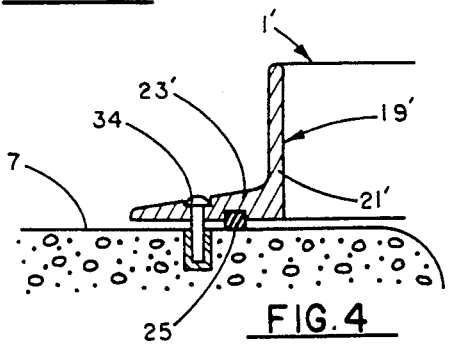
FIG. 4 is a view similar to FIG. 3, but showing an alternate embodiment of the present invention.

In FIGS. 1-3, the retainer 19 is shown having the flange 23 thereof located radially inwardly of the tube section 21. Turning to FIG. 4, an alternately constructed retainer 19' is illustrated wherein the flange 23' is located radially outwardly of the tube section 21'. The seal 25 and the remainder of the construction and function of the sump protection system 1' remains the same with the modified retainer 19' as with the retainer 19 described in conjunction with FIGS. 1-3.

The retainer 19 may be manufactured from any suitable material and in any suitable size. However, I have found that a retainer molded as a unitary piece from polyurethane plastic material works very well. Further, I have found that a retainer with a tube section diameter of approximately 27 inches, an overall height of approximately 3 inches, a one-eighth inch wall thickness, and an inner diameter of approximately 21 inches for the flange 23 gives excellent results. With the sump protection system 1 in place, a person can leave his home or other building without the worry that he will return to a flooded basement.

Thus, it is apparent that there has been provided, in accordance with the invention, a sump protection system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A sump protection system comprising:

a. an uncovered retainer comprising:

i. a tube having a central axis and a predetermined diameter and a predetermined height, the diameter being approximately nine times greater than the height, the tube having an exposed top end and a lower end;

ii. an annular flange extending radially from the tube lower end, the flange having an inner diameter sufficient to surround a sump in a building floor and being detached therefrom, the flange having upper and bottom surfaces; and iii. a spout formed in the tube;

b. seal means bonded to the flange bottom surface and contactable with the building floor for cooperating with the tube and flange to confine any water rising above the sump to be confined within the retainer; and c. hose means clamped to the spout for directing any water within the retainer to a selected location therefrom, so that the building portions in the vicinity of the sump are protected against any water overflowing from the sump.

2. In combination with a building floor having a sump therein, apparatus for protecting the building from water overflowing from the sump comprising:

a. an uncovered retainer comprising:

i. a tube having a large diameter relative to the tube height, a central axis, and exposed top and lower ends, the tube surrounding the sump and being detached therefrom;

ii. an annular flange extending radially of the tube lower end and having upper and bottom surfaces, the bottom surface being formed with an annular groove therein; and iii. a spout formed in the tube;

b. a seal retained in the flange groove and in contact with the building floor and surrounding the sump, the seal and the retainer cooperating to confine within the retainer any water rising in the sump above the building floor; and c. hose means clamped to the spout for directing the water confined in the retainer to a selected location remote from the sump.

* * * * *